US006089222A

United States Patent [19]

Ban et al.

[11] Patent Number: 6,089,222

[45] **Date of Patent: *Jul. 18, 2000**

[54] VISCOUS HEATER

[75] Inventors: Takashi Ban; Hidefumi Mori; Kiyoshi Yagi, all of Kariya, Japan

[73] Assignee: Kabushiki Kaisha Toyoda Jidoshokki Seisakusho, Aichi-ken, Japan

[ * ] Notice: This patent is subject to a terminal disclaimer.

[21] Appl. No.: 08/836,186

[22] PCT Filed: Aug. 22, 1996

[86] PCT No.: PCT/JP96/02361

§ 371 Date: Apr. 23, 1997

§ 102(e) Date: Apr. 23, 1997

[87] PCT Pub. No.: WO97/08001

PCT Pub. Date: Mar. 6, 1997

[30] Foreign Application Priority Data

Aug. 25, 1995 [JP] Japan ..... 7-217035

[51] Int. Cl.[7] ..... F24C 9/00

[52] U.S. Cl. ..... 126/247; 122/26

[58] Field of Search ..... 126/247; 122/26

[56] References Cited

U.S. PATENT DOCUMENTS

| | | | |
|---|---|---|---|
| 2,090,873 | 8/1937 | Lazarus | 122/26 |
| 3,075,514 | 1/1963 | Paugh | 126/247 |
| 4,188,996 | 2/1980 | Pellant et al. | 165/80.4 |
| 4,993,377 | 2/1991 | Itakura . | |
| 5,034,688 | 7/1991 | Moulene et al. | 165/80.4 |
| 5,573,184 | 11/1996 | Martin | 122/26 |
| 5,875,741 | 3/1999 | Mori et al. | 126/247 |
| 5,881,711 | 3/1999 | Ban et al. | 126/247 |
| 5,881,712 | 3/1999 | Mori et al. | 126/247 |

FOREIGN PATENT DOCUMENTS

| | | |
|---|---|---|
| 0053375 | 6/1982 | European Pat. Off. . |
| 2505996 | 11/1982 | France . |
| 2-246823 | 2/1990 | Japan . |
| 4-11716 | 1/1992 | Japan . |

*Primary Examiner*—Carl D. Price

*Attorney, Agent, or Firm*—Morgan & Finnegan, L.L.P.

[57] ABSTRACT

A viscous heater is provided which can carry out full heat exchange securely. For instance, fins 2*c* through 2*f* are formed in a housing, and project into a water jacket RW. Thus, a surface area of a wall surface constituting the water jacket RW is enlarged, and a circulating fluid, taken in through a water inlet port 8 and delivered out to an external heating circuit through a water outlet port 9, is circulated along a specific route.

17 Claims, 6 Drawing Sheets

VISCOUS HEATER

TECHNICAL FIELD

The present invention relates to a viscous heater in which a viscous fluid is caused to generate heat by shearing. The resulting heat is utilized as a thermal source for heating by carrying out heat exchange with a circulating fluid which circulates in a radiator chamber.

BACKGROUND ART

Conventionally, in Japanese Unexamined Patent Publication (KOKAI) No. 2-246,823, a viscous heater is disclosed which is utilized as a heating apparatus for a vehicle. In this viscous heater, a front housing and a rear housing are disposed so as to face with each other, and are fastened by through bolts, thereby forming a heat-generating chamber and a water jacket therein. The water jacket is disposed around an outer region of the heat-generating chamber. In the water jacket, circulating water is circulated so that it is taken in through a water inlet port, and that it is delivered out to an external heating circuit through a water outlet port. In the front housing, a driving shaft is held rotatably via a bearing apparatus. To the driving shaft, a rotor is fixed so that it can rotate in the heat-generating chamber. A wall surface of the heat-generating chamber and an outer surface of the rotor constitute labyrinth grooves which approach to each other. In a space between the wall surface of the heat-generating chamber and the outer surface of the rotor, a viscous fluid, such as a silicone oil, is interposed.

In the viscous heater built into a vehicle heating apparatus, the rotor rotates in the heat-generating chamber when the driving shaft is driven by an engine. Accordingly, the viscous fluid is caused to generate heat by shearing in the space between the wall surface of the heat-generating chamber and the outer surface of the rotor. The thus generated heat is heat-exchanged to the circulating water in the water jacket. The heated circulating water is used at the heating circuit to heat a vehicle.

Moreover, in Japanese Unexamined Utility Model Publication (KOKAI) No. 4-11,716, a viscous heater is disclosed in which fins are projected into a water jacket. In this viscous heater, heat exchange can be carried out with a relatively high efficiency, because the fins enlarge a surface area of a wall surface constituting the water jacket.

However, in the viscous heater set forth in Japanese Unexamined Patent Publication (KOKAI) No. 2-246,823, heat exchange cannot necessarily be carried out fully, because the surface area of the wall surface constituting the water jacket is relatively small, and because there is a fear of short-circuiting or retaining the circulating water in the water jacket.

Likewise, in the viscous heater set forth in Japanese Unexamined Utility Model Publication (KOKAI) No. 4-11, 716, heat exchange cannot necessarily be carried out fully, because there is a fear of short-circuiting or retaining the circulating water in the water jacket.

It is therefore an assignment to the present invention to provide a viscous heater which can carry out full heat exchange securely.

Measures for Solving the Assignment

A viscous heater in accordance with the invention comprises:

a housing in which a heat-generating chamber, and a radiator chamber are formed, the radiator chamber neighboring the heat-generating chamber and circulating a circulating fluid therein;

a driving shaft held rotatably to the housing by way of a bearing apparatus;

a rotor disposed in the heat-generating chamber rotatably by the driving shaft; and a viscous fluid interposed in a space between a wall surface of the heat-generating chamber and an outer surface of the rotor, and caused to generate heat by the rotating rotor;

wherein a fin is formed in the housing, and projects into the radiator chamber to enlarge a surface area of a wall surface constituting the radiator chamber and to circulate the circulating fluid, taken in through a first port and delivered out to an external heating circuit through a second port, along a specific route.

In the viscous heater set forth in claim 1, the fin projects into the radiator chamber not only to enlarge a surface area of a wall surface constituting the radiator chamber, but also to circulate the circulating fluid, taken in through a first port, along a specific route in the radiator chamber and to deliver the circulating fluid out to an external heating circuit through a second port. Thus, there is no fear of short-circuiting or retaining the circulating water in the radiator chamber, and consequently full heat exchange can be carried out securely.

A viscous heater is also characterized in that the fin of the viscous heater projects from a wall-surface side of the housing, and in that a leading end of the fin is kept from contacting with another wall-surface side of the housing.

In the viscous heater, the fin is kept from contacting with another wall-surface side of the housing. Accordingly, the heat is less likely to transfer directly from an wall-surface side of the housing to another wall-surface side thereof Thus, the heat is radiated less off from the housing to the outside.

A viscous heater is also characterized in that the fin of the viscous heater includes a plurality of upright walls which extend in a direction of flow, and in that a fluid passage disposed in the radiator chamber is divided by the upright walls to have a fluid-passage width which is expanded more on an outer peripheral side thereof.

In the viscous heater, the flows of the circulating fluid, divided by the fluid passage branched in the radiator chamber, can circulate at a substantially equal flow velocity in the radiator chamber. Consequently, efficient heat exchange can be carried out in the outer peripheral region of the rotor where the heat is evolved considerably.

A viscous heater is also characterized in that the radiator chamber of the viscous heater includes a front radiator chamber neighboring in front of the heat-generating chamber, and a rear radiator chamber neighboring in rear of the heat-generating chamber, and in that the circulating fluid, taken in through the first port, is divided equally into the front radiator chamber and the rear radiator chamber.

In the viscous heater, the circulating fluid is divided equally into the front radiator chamber and the rear radiator chamber. Accordingly, effective heat exchange can be carried out.

A viscous heater is also characterized in that the housing of the viscous heater is provided with a flow divider for dividing the circulating fluid into the front radiator chamber and the rear radiator chamber, and in that the flow divider has a configuration free from exhibiting resistance.

In the viscous heater the flow divider divides the circulating fluid into the front radiator chamber and the rear radiator chamber. At this moment, the flow divider has a configuration free from exhibiting resistance. Consequently, the pressure loss is small in the passage, and the flow velocity of the circulating fluid is less likely to decrease in the entire heating circuit. Thus, the viscous heater is good in terms of heat-exchanging ability.

A viscous heater is also characterized in that the fin of the viscous heater has an equal surface in the front radiator chamber and the rear radiator chamber.

Suppose heat-exchanging rates differing in the front and rear radiator chambers cause the temperature difference in the circulating fluid flowing in the front radiator chamber and the rear radiator chamber. When the heat generation is equal on the front and rear surfaces of the rotor, heat transfer is carried out between the front and rear radiator chambers. Accordingly, thermal loss arises during the heat transfer. In this respect, in the viscous heater the heat-exchanging rates are equal in the front and rear radiator chambers, and there is no temperature difference in the circulating fluid flowing in the front radiator chamber and the rear radiator chamber. Thus, the viscous heater is less likely to cause the thermal loss.

A viscous heater is also characterized in that the first port and the second port of the viscous heater are formed in an identical surface.

In the viscous heater, the first port and the second port are formed in an identical surface. Consequently, the viscous heater can be manufactured readily, and is good in terms of boardability on a vehicle, or the like.

A viscous heater is also characterized in that the first port and the second port of the viscous heater are disposed next to each other.

In the viscous heater the first port and the second port are disposed next to each other. Accordingly, the viscous heater is much better in terms of boardability on a vehicle, or the like.

BEST MODE FOR CARRYING OUT THE INVENTION

The First and Second Preferred Embodiments embodying the present invention set forth in the appended claims will be hereinafter described with reference to the drawings.

(First Preferred Embodiment)

Figure 1:
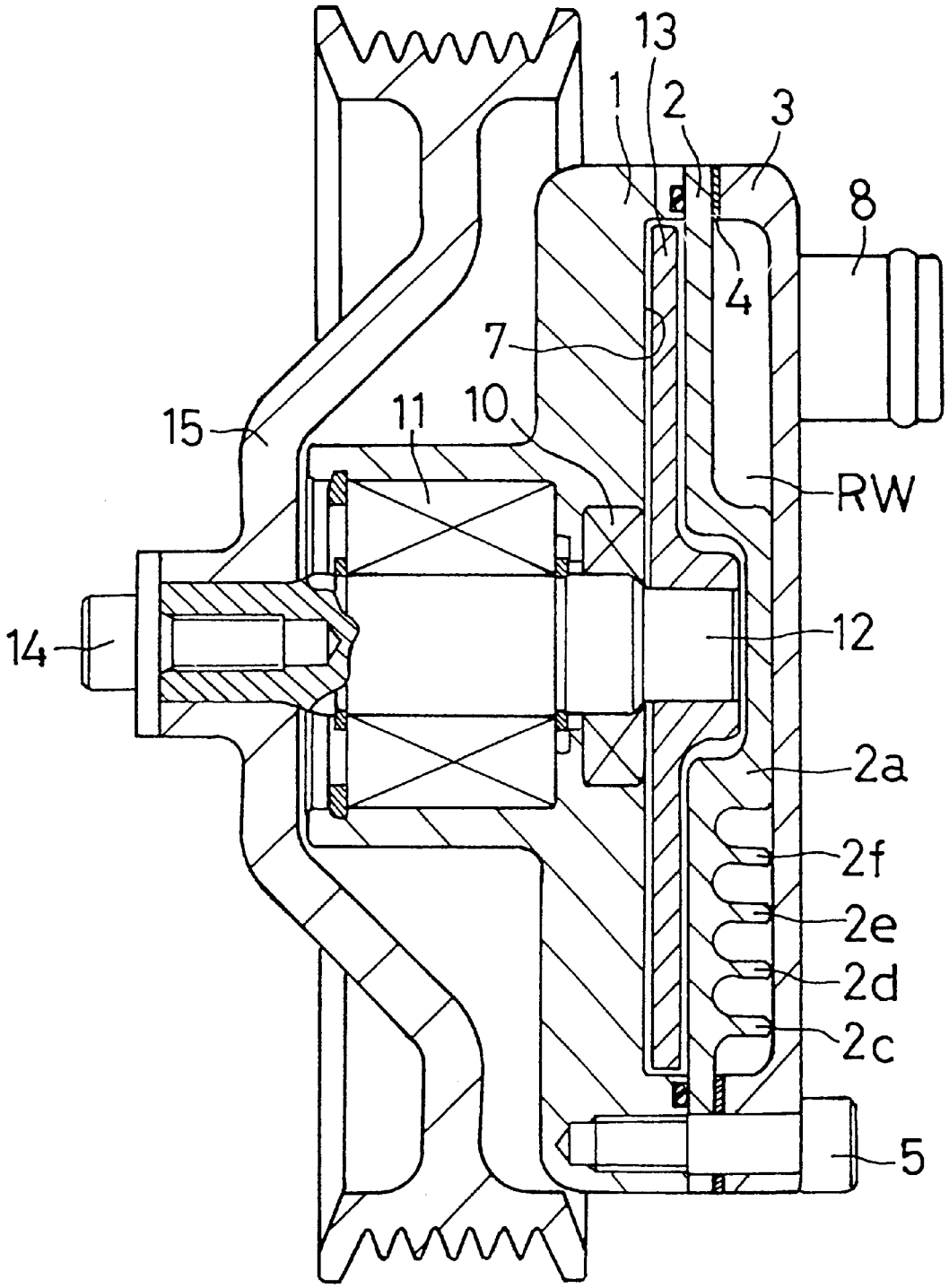
FIG. 1 is a vertical cross-sectional view of a viscous heater of a First Preferred Embodiment.

As illustrated in FIG. 1, in the viscous heater, a front housing 1, a rear plate 2 and a rear housing body 3 are overlapped and fastened by a plurality of through bolts 5 with a gasket 4 interposed between the rear plate 2 and the rear housing body 3. Further, a concavity is formed in a rear-end surface of the front housing 1, and forms a heat-generating chamber 7 together with a flat front-end surface of the rear plate 2. Furthermore, a rear-end surface of the rear plate 2 and an inner surface of the rear housing body 3 form a rear water jacket RW. The rear water jacket RW works as the rear radiator chamber neighboring the heat-generating chamber 7.

Figure 2:
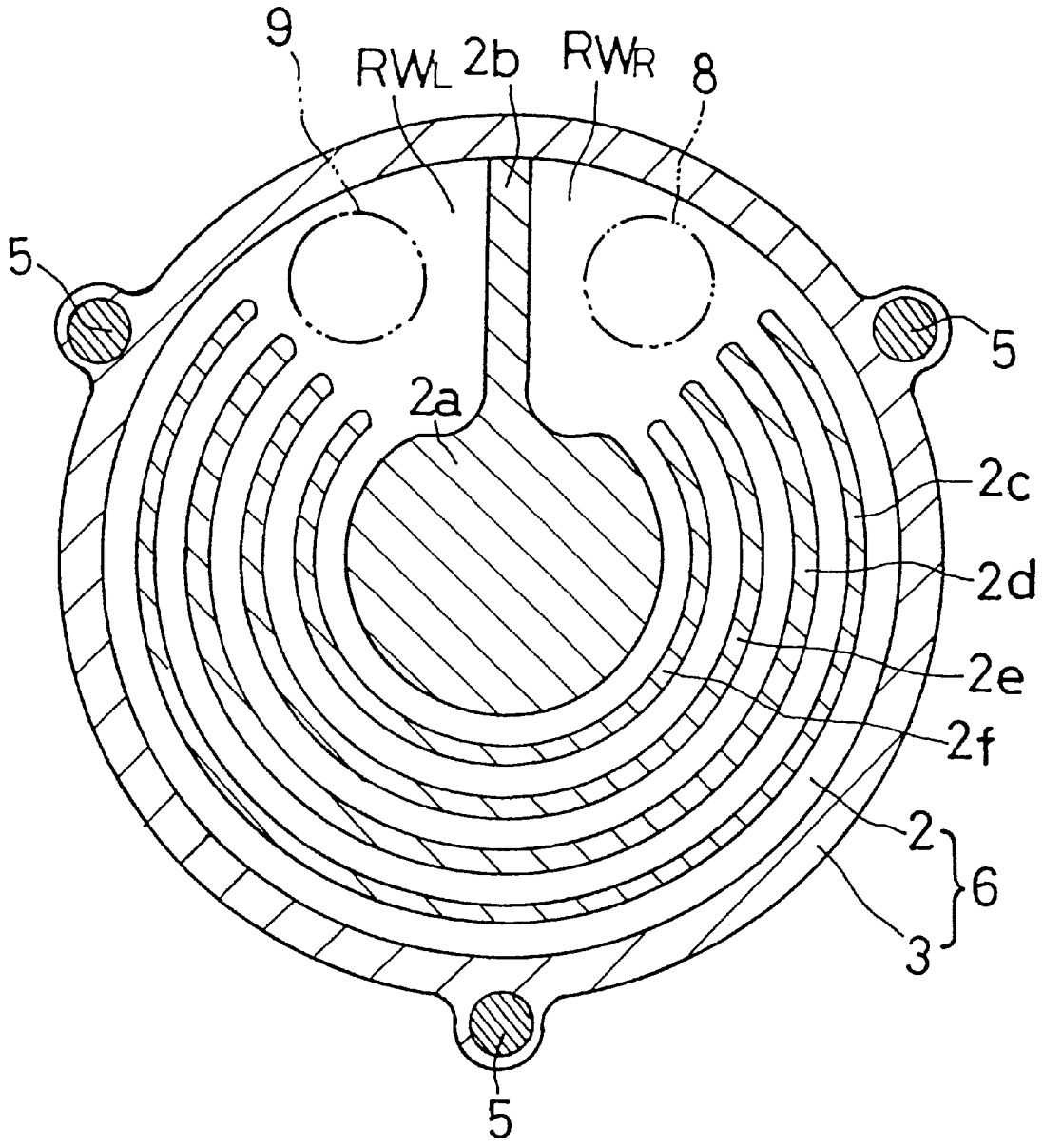
FIG. 2 is a horizontal cross-sectional view of the viscous heater of the First Preferred Embodiment.

As illustrated in FIG. 2, in an outer region on a rear surface of the rear housing body 3, a water inlet port 8 and a water outlet port 9 are formed next to each other. The water inlet port 8 works as the first port for taking in circulating water, operating as the circulating fluid, from an external heating circuit (not shown). The water outlet port 9 works as the second port for delivering the circulating water out to the heating circuit. The water inlet port 8 and the water outlet port 9 are communicated with the rear water jacket RW. Thus, in the viscous heater, the water inlet port 8 and the water outlet port 9 are formed next to each other in the identical surface. As a result, the viscous heater can be manufactured readily, and is good in terms of boardability on a vehicle.

On a rear-end surface of the rear plate 2, a cylindrical convexity 2*a* is protruded in a central area, and a partition wall 2*b*, which extends from the convexity 2*a* in a radial direction, is protruded between the water inlet port 8 and the water outlet port 9. Moreover, on the rear-end surface of the rear plate 2, fins 2*c* through 2*f* are protruded in an axial direction. The fins 2*c* through 2*f* include four rows of upright walls which extend like an arc around the convexity 2*a* from an area adjacent to the water inlet port 8 to another area adjacent to the water outlet port 9. As illustrated in FIG. 1, the leading end of the convexity 2*a*, the partition wall 2*b* and the fins 2*c* through 2*f* contacts with the inner surface of the rear housing body 3. Accordingly, in the viscous heater, heat is likely to be transmitted by the direct contact between the rear plate 2 and the rear housing body 3.

In addition, a shaft-sealing apparatus 10, and a bearing apparatus 11 are disposed in the front housing 1. The shaft-sealing apparatus 10 neighbors with the heat-generating chamber 7. By way of the shaft-sealing apparatus 10 and the bearing apparatus 11, a driving shaft 12 is held rotatably. At the trailing end of the driving shaft 12, a plate-shaped rotor 13 is press-fitted so that it can rotate in the heat-generating chamber 7. A silicone oil, working as the viscous fluid, is interposed in the space between the wall surface of the heat-generating chamber 7 and the outer surface of the rotor 13. Thus, in the viscous heater, there is no fear of leaking the silicone oil to the outside, because the shaft-sealing apparatus 10 is disposed between the heat-generating chamber 7 and the bearing apparatus 11 in the front housing 1. At the leading end of the driving shaft 12, a pulley 15 is fixed by a bolt 14. The pulley 15 is rotated by a vehicle engine via a belt.

In the viscous heater built-into a vehicle heating apparatus, the rotor 13 is rotated in the heat-generating chamber 7 when the driving shaft 12 is driven by the engine by way of the pulley 15. Accordingly, the silicone oil is sheared in the space between the wall surface of the heat-generating chamber 7 and the outer surface of the rotor 13, thereby generating heat. The resulting heat is heat-exchanged to the circulating water flowing in the rear water jacket RW, and the thus heated circulating water is used for heating a vehicle in the heating circuit.

Figure 3:
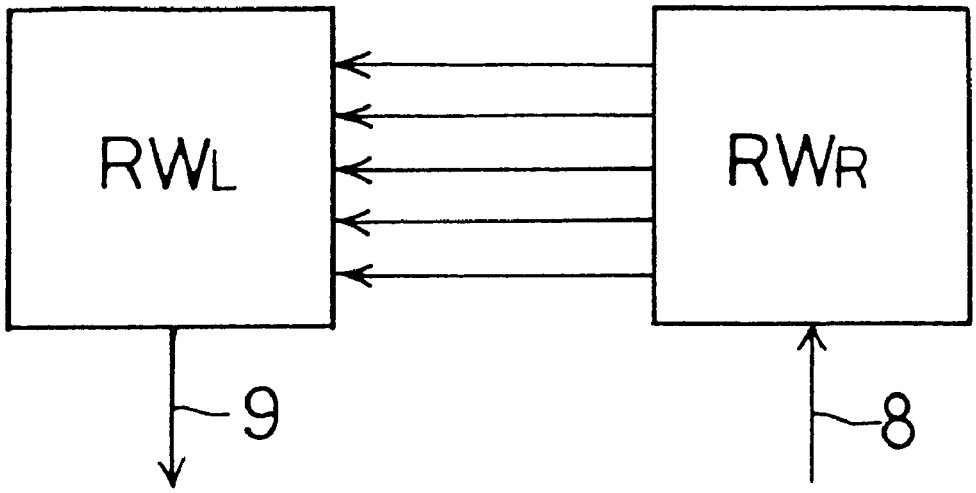
FIG. 3 is concerned with the viscous heater of the First Preferred Embodiment, and is a schematic diagram for illustrating a flow of circulating water therein.

At this moment, as illustrated in FIG. 3, the circulating water is taken in into a right-side chamber $RW_R$, viewed from the rear inside of the rear water jacket RW, through the water inlet port 8. The circulating water then follows the five paths or routes which are formed by the convexity 2*a*, the partition wall 2*b* and the fins 2*c* through 2*f* and arrives at a left-side chamber RWL, viewed from the rear of the rear water jacket RW. Eventually, the circulating water is delivered out to the heating circuit through the water outlet port 9. Thus, in the viscous heater, the surface area of the wall surface constituting the rear water jacket RW is enlarged comparatively. In addition, in the viscous heater, there is no fear of short-circuiting or retaining the circulating water in the rear water jacket RW, because the circulating water, taken in through the water inlet port 8, is circulated in a peripheral direction in the rear water jacket RW, and is delivered out to the external heating circuit through the water outlet port 9. Hence, full heat exchange can be carried out securely.

As a result, the viscous heater is capable of carrying out full heat exchange.

Note that, instead of the pulley 15, an electromagnetic clutch can be employed to intermittently drive the driving shaft 12.

(Second Preferred Embodiment)

Figure 4:
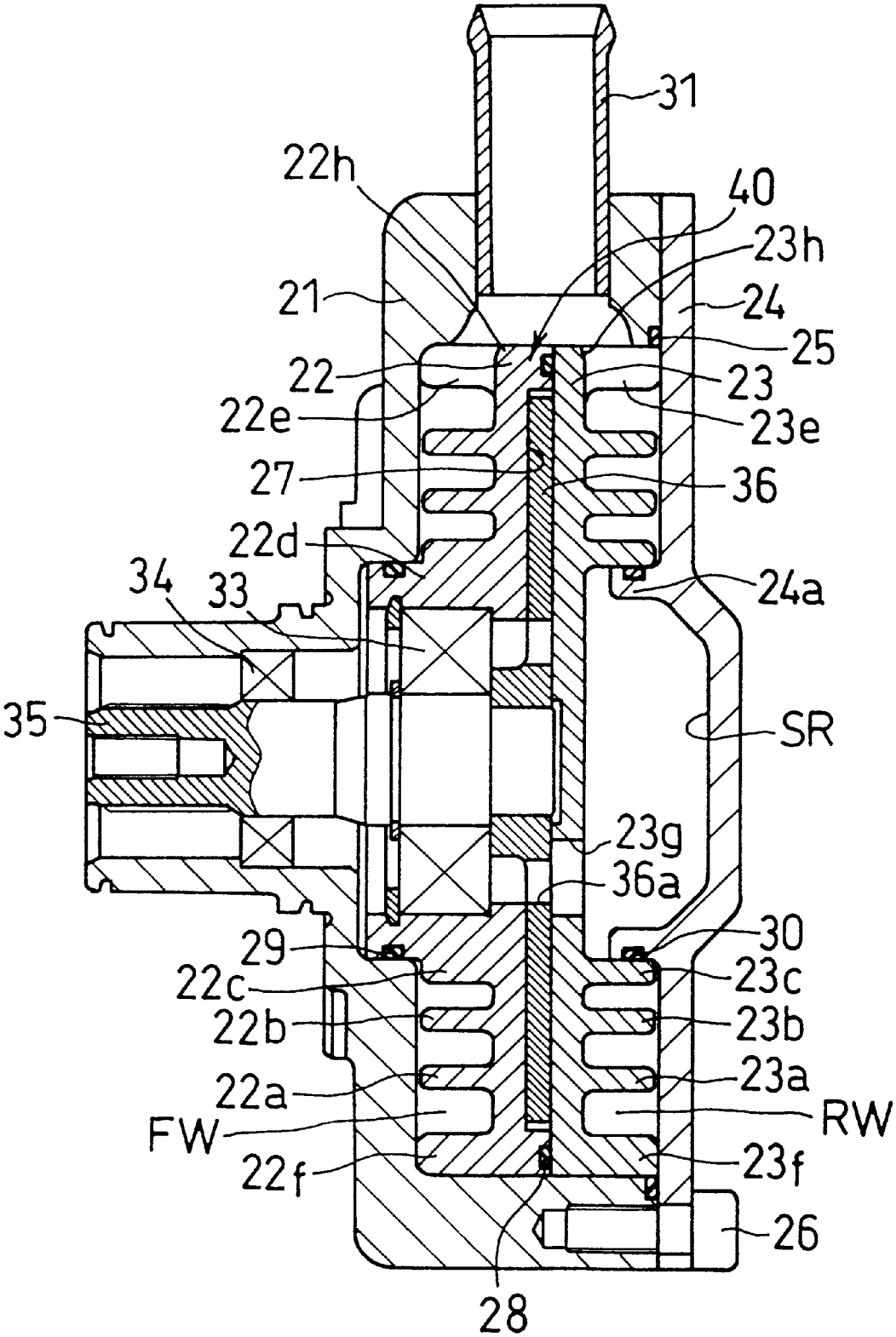
FIG. 4 is a vertical cross-sectional view of a viscous heater of a Second Preferred Embodiment.

As illustrated in FIG. 4, in the viscous heater, a front plate 22 and a rear plate 23 are accommodated in a cup-shaped front housing body 21. Moreover, at an end of the front housing body 21, a plate-shaped rear housing body 24 is connected by bolts 26 via an O-ring 25.

In a rear-end surface of the front plate 22, a concavity is provided, and forms a heat-generating chamber 27 together with a flat front-end surface of the rear plate 23. Around the heating chamber 27, there is disposed an O-ring 28. Further, on the central portion of the front plate 22, there is projected a boss 22*d* which is made integral with a fin 22*c* later described. In an outer peripheral surface of the boss 22*d*, there is disposed an O-ring 29 between the front housing body 21 and the boss 22*d*. The front-end surface of the front plate 22 and the inner surface of the front housing body 21 form a front water jacket FW. The front water jacket FW works as the front radiator chamber neighboring in front of the heat-generating chamber 27. Furthermore, on the central portion of the rear housing body 24 as well, there is projected a boss 24*a*. In an outer peripheral surface of the boss 24*a*, there is disposed an O-ring 30 between the outer peripheral surface of the boss 24*a* and a fin 23*c* of the rear plate 23 later described. The rear-end surface of the rear plate 23 and the inner surface of the rear housing body 24 form a rear water jacket RW. The rear water jacket RW works as the rear radiator chamber neighboring in rear of the heat-generating chamber 27.

Around the front plate 22, there is projected a supporter wall 22*f* forwardly in an axial direction. In the supporter wall 22*f*; an opening 22*e* and another similar opening (not shown) are drilled through in a radial direction. The opening 22*e* communicates with a water inlet port 31 later described. The another opening communicates with a water outlet port 32 (see FIG. 5.). Moreover, around the rear plate 23 as well, there is projected a supporter wall 23*f* rearwardly in an axial direction. In the supporter wall 23*f* as well, an opening 23*e* and another similar opening (not shown) are drilled through in a radial direction. The opening 23*e* communicates with the water inlet port 31. The other opening communicates with the water outlet port 32. The rims of the front plate 22 and rear plate 23, disposed between the opening 22*e* and 23*e*, constitute a flow divider 40. On the flow divider 40, there are formed chamfered portions 22*h*, 23*h* on the side of the water inlet port 31. The chamfered portions 22*h*, 23*h* work as the configuration free from exhibiting resistance. Note that the portion around the another openings communicating with the water outlet port 32 is constructed likewise.

Further, on the front-end surface of the front plate 22, fins 22*a* through 22*c* (Note that, however, the fin 22*c* are formed as a ring shape to be integral with the boss 22*d*.) are protruded in an axial direction in the front water jacket FW. The fins 22*a* through 22*d* include three rows of upright walls which extend like an arc around an axis inside the supporter wall 22*f*. Likewise, on the rear-end surface of the rear plate 23, fins 23*a* through 23*c* (Note that, however, the fin 23*c* is formed as a ring shape.) are protruded in an axial direction in the rear water jacket RW. The fins 23*a* through 23*c* include three rows of upright walls which extend like an arc around an axis inside the supporter wall 23*f*. Note that the leading ends of the fins 22*a* through 22*c* are not brought into contact with the inner surface of the front housing body 21, and that the leading ends of the fins 23*a* through 23*c* are not brought into contact with the inner surface of the rear housing body 24. Consequently, in this viscous heater, heat is less likely to be transferred directly from the front plate 22 to the front housing body 21, and is less likely to be transferred directly from the rear plate 23 to the rear housing body 24. Thus, the heat is radiated less from the housing to the outside. Furthermore, as the flow passages (specific routes) of the water jackets FW, RW approach the outer peripheral side, the flow-passage widths thereof are enlarged by the fins 22*a* through 22*c*, and by the fins 23*a* through 23*c*. Moreover, the surface areas of the fins 22*a* through 22*c* are made equal to those of the fins 23*a* through 23*c*.

In addition, between the rear plate 23 and the rear housing body 24, there is formed a reservoir chamber SR by the inner surface of the fin 23*c* and the rear housing body 24. A supplier hole 23*g* and a collector hole (not shown) are drilled through the rear plate 23 in a longitudinal direction, and are communicated with the reservoir chamber SR.

On an upper side of the peripheral surface of the front housing body 21, there are formed the water inlet port 31 and the water outlet port 32 (see FIG. 5.) next to each other. The water inlet port 31 works as the first port for taking in circulating water, operating as the circulating fluid, from an external heating circuit (not shown). The water outlet port 32 works as the second port for delivering the circulating water out to the heating circuit. The water inlet port 31 and the water outlet port 32 are communicated with the front water jacket FW and the rear water jacket RW by way of the openings 22*e*, 23*e*, and the like. Thus, in the viscous heater, the water inlet port 31 and the water outlet port 32 are formed next to each other in the identical surface. As a result, the viscous heater can be manufactured readily, and is good in terms of suitability of installation on a vehicle.

In addition, in the boss 22*d* of the front plate 22, there is disposed a bearing apparatus 33 which includes a built-in shaft-sealing apparatus. In the front housing 21, there is disposed a bearing apparatus 34. By way of the bearing apparatuses 33, 34, a driving shaft 35 is held rotatably. At the trailing end of the driving shaft 35, a plate-shaped rotor 36 is press-fitted so that it can rotate in the heat-generating chamber 27. A communication hole 36*a* is drilled through the rotor 36 in a longitudinal direction. In the space between the wall surface of the heat-generating chamber 27 and the outer surface of the rotor 36, there is interposed a silicone oil working as the viscous fluid. At the leading end of the driving shaft 35, similarly to the First Preferred Embodiment, there is fixed a pulley (not shown). The pulley is rotated by a vehicle engine via a belt.

Figure 5:
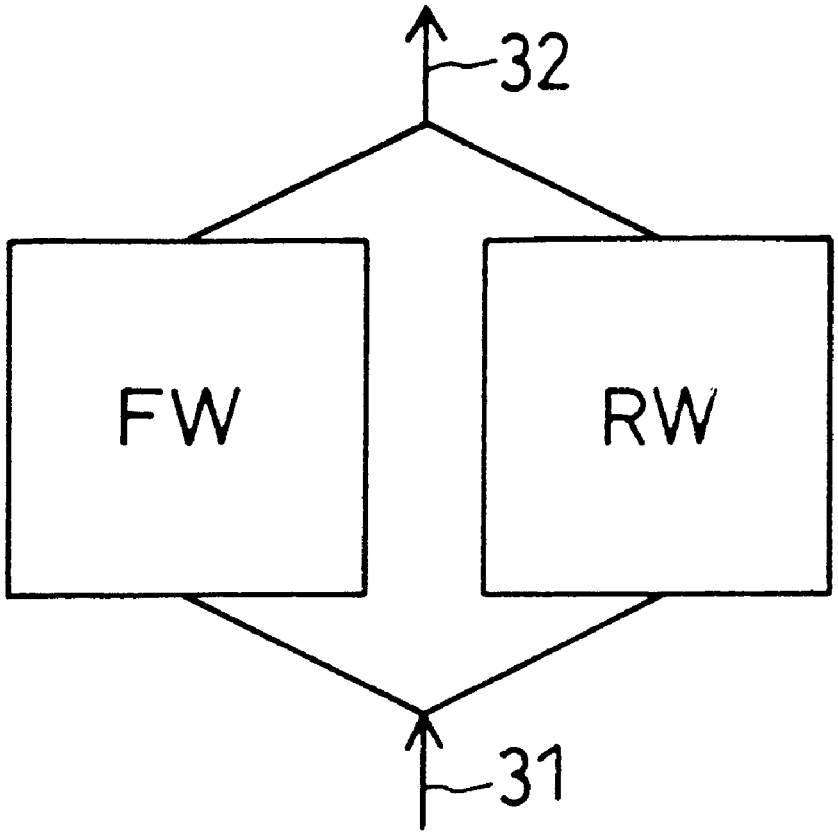
FIG. 5 is concerned with the viscous heater of the Second Preferred Embodiment, and is a schematic diagram for illustrating a flow of circulating water therein.

As illustrated in FIG. 5, in the thus constructed viscous heater, the flow divider 40 divides the flow of the circulating water, taken in through the water inlet port 31, into the front water jacket FW and the rear water jacket RW equally. On this occasion, the pressure loss is small in the passages, and the flow velocity of the circulating fluid is less likely to drop in the entire heating circuit, because the chamfered portions 22*h*, 23*h* are formed on the flow divider 40. Then, by way of the openings 22*e*, 23*e*, the circulating water is divided into the front water jacket FW and the rear water jacket RW equally. Thereafter, the equally-divided parts of the circulating water are circulated by the fins 22*a* through 22*c*, and by the fins 23*a* through 23*c* at an equal flow velocity in the front and rear water jackets FW, RW, respectively, and are finally delivered out to the outside heating circuit through the water outlet port 32. In this case, the heat generation is carried out in the outer peripheral area of the rotor 36 considerably. However, in the outer-peripheral-area flow passages whose flow-passage widths are enlarged, heat exchange can be carried out by the enlarged surface area in proportion to the heat generation.

As a result, in the thus constructed viscous heater as well, effective heat exchange can be carried out. Unless otherwise specified, the Second Preferred Embodiment operates and produces advantages in the same manner as the First Preferred Embodiment.

(First Modified Version)

Figure 6:
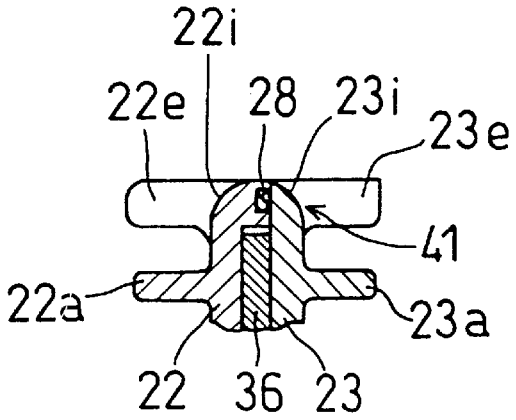
FIG. 6 is concerned with a viscous heater of a First Modified Version, and is a cross-sectional view of a flow divider thereof.

In the First Modified Version, a flow divider 41 shown in FIG. 6 is employed. On the flow divider 41, there are formed arcs 22*i*, 23*i* on the side of the water inlet port 31. The arcs 22*i*, 23*i* work as the configuration free from exhibiting resistance. Note that the portion around the another openings communicating with the water outlet port 32 is constructed likewise. Unless otherwise specified, the arrangements of the First Modified Version are identical with those of the Second Preferred Embodiment.

The viscous heater of the First Modified Version can also operate and produce advantages in the same manner as the Second Preferred Embodiment.

(Second Modified Version)

Figure 7:
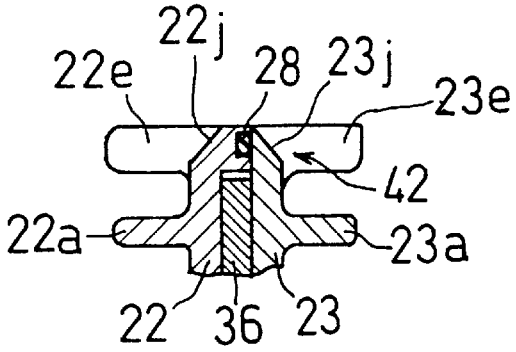
FIG. 7 is concerned with a viscous heater of a Second Modified Version, and is a cross-sectional view of a flow divider thereof.

In the Second Modified Version, a flow divider 42 shown in FIG. 7 is employed. On the flow divider 42, there are formed tapered portions 22*j*, 23*j* on the side of the water inlet port 31. The tapered portions 22*j*, 23*j* work as the configuration free from exhibiting resistance. Note that the portion around the another openings communicating with the water outlet port 32 is constructed likewise. Unless otherwise specified, the arrangements of the Second Modified Version are identical with those of the Second Preferred Embodiment.

The viscous heater of the Second Modified Version can also operate and produce advantages in the same manner as the Second Preferred Embodiment.

(Third Modified Version)

Figure 8:
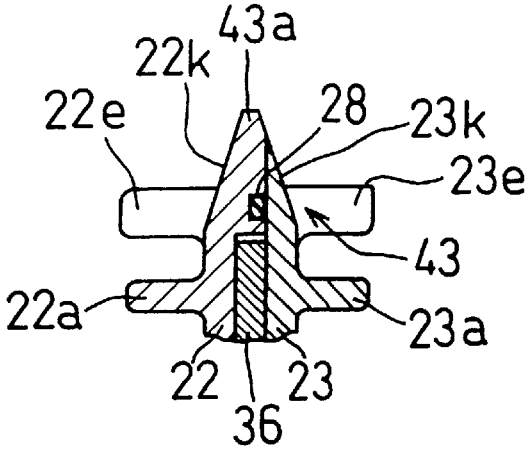
FIG. 8 is concerned with a viscous heater of a Third Modified Version, and is a cross-sectional view of a flow divider thereof.

In the Third Modified Version, a flow divider 43 shown in FIG. 8 is employed. The flow divider 43 is formed by protruding part of the front plate 22 and the rear plate 23, disposed between the openings 22*e* and 23*e*, in an outer peripheral direction. On the flow divider 43, there are formed tapered portions 22*k*, 23*k* on the side of the water inlet port 31. The tapered portions 22*k*, 23*k* work as the configuration free from exhibiting resistance. Note that the portion around the another openings communicating with the water outlet port 32 is constructed likewise. Unless otherwise specified, the arrangements of the Third Modified Version are identical with those of the Second Preferred Embodiment.

The viscous heater of the Third Modified Version can also operate and produce advantages in the same manner as the Second Preferred Embodiment.

What is claimed is:

1. A viscous heater, comprising:

a housing in which a heat-generating chamber and a radiator chamber are formed, said radiator chamber being adjacent to said heat-generating chamber and having an inlet port and an outlet port for circulating a circulating fluid through said radiator chamber;

a driving shaft held rotatably to said housing by way of a bearing apparatus;

a rotor disposed in said heat-generating chamber for rotation by said driving shaft; and a space between a wall surface of said heat-generating chamber and an outer surface of said rotor for containing viscous fluid for generating heat upon rotation of said rotating rotor;

said housing having at least one fin projecting into said radiator chamber to enlarge the surface area of a wall surface constituting said radiator chamber, said fin comprising a plurality of upright walls extending along paths subdividing said radiator chamber into radially spaced branched fluid passages formed along parallel arcuate paths, wherein the widths of said fluid passages are expanded on the outer peripheral side of the passages, to circulate said circulating fluid between said inlet and outlet ports.

2. A viscous heater according to claim 1, wherein said fin projects from said wall surface of said housing, and has a leading end spaced from all other wall surfaces of said housing.

3. A viscous heater according to claim 2, wherein said radiator chamber includes a front radiator chamber adjacent the front of said heat-generating chamber, and a rear radiator chamber adjacent the rear of said heat-generating chamber, and said circulating fluid, when taken in through said inlet port, is divided into the front radiator chamber and the rear radiator chamber.

4. A viscous heater comprising:

a housing in which a heat-generating chamber, and a radiator chamber are formed, said radiator chamber being adjacent to said heat-generating chamber and having inlet and outlet ports for circulating fluid through said radiator chamber;

a driving shaft held rotatable to said housing by way of a bearing apparatus:

a rotor disposed in said heat-generating chamber for rotation by said driving shaft; and a viscous fluid interposed in a space between a wall surface of said heat-generating chamber and an outer surface of said rotor for generating heat upon rotation of said rotating rotor, wherein a fin is formed in said housing and projects into said radiator chamber to enlarge the surface area of a wall surface constituting said radiator chamber, said fin subdividing said radiator chamber into branched fluid passages for the circulating fluid between said inlet and outlet ports, said radiator chamber including a front radiator chamber adjacent the front of said heat-generating chamber, and a rear radiator chamber adjacent the rear of said heat-generating chamber, and said circulating fluid, when taken in through said inlet port, is divided into the front radiator chamber and the rear radiator chamber.

5. A viscous heater according to claim 3, wherein said fin has an equal surface in said front radiator chamber and said rear radiator chamber.

6. A viscous heater comprising:

a housing in which a heat-generating chamber, and a radiator chamber are formed, said radiator chamber being adjacent to said heat-generating chamber and having inlet and outlet ports for circulating fluid through said radiator chamber;

a driving shaft held rotatably to said housing by way of a bearing apparatus;

a rotor disposed in said heat-generating chamber for rotation by said driving shaft; and a space between a wall surface of said heat-generating chamber and an outer surface of said rotor for containing viscous fluid for generating heat upon rotation of said rotating rotor; and a fin projecting from said housing into said radiator chamber to enlarge the surface area of a wall surface constituting said radiator chamber, said fin subdividing said radiator chamber into branched fluid passages for the circulating fluid between said inlet and outlet ports, said radiator chamber including a front radiator chamber adjacent the front of said heat-generating chamber, and a rear radiator chamber adjacent the rear of said heat-generating chamber, and said circulating fluid, when taken in through said inlet port, is divided equally into the front radiator chamber and the rear radiator chamber.

7. A viscous heater according to claim 6, wherein said housing further comprises a flow divider for dividing said circulating fluid into said front radiator chamber and said rear radiator chamber, the flow divider having a configuration free from exhibiting resistance.

8. A viscous heater according to claim 6, wherein said fin has an equal surface in said front radiator chamber and said rear radiator chamber.

9. A viscous heater according to claim 1, wherein said inlet port and said outlet port are formed in the same surface.

10. A viscous heater according to claim 1, wherein said radiator chamber includes a front radiator chamber adjacent the front of said heat-generating chamber, and a rear radiator chamber adjacent the rear of said heat-generating chamber, and said circulating fluid, when taken in through said inlet port, is divided into the front radiator chamber and the rear radiator chamber.

11. A viscous heater according to claim 3, wherein said radiator chamber includes a front radiator chamber adjacent the front of said heat-generating chamber, and a rear radiator chamber adjacent the rear of said heat-generating chamber, and said circulating fluid, when taken in through said inlet port, is divided into the front radiator chamber and the rear radiator chamber.

12. A viscous heater comprising:

a housing in which a heat-generating chamber, and a radiator chamber are formed, said radiator chamber being adjacent to said heat-generating chamber and having inlet and outlet ports for circulating fluid through said radiator chamber;

a driving shaft held rotatably to said housing by way of a bearing apparatus;

a rotor disposed in said heat-generating chamber for rotation by said driving shaft; and a space between a wall surface of said heat-generating chamber and an outer surface of said rotor for containing viscous fluid for generating heat upon rotation of said rotating rotor; and a fin projecting from said housing into said radiator chamber to enlarge the surface area of a wall surface constituting said radiator chamber, said fin subdividing said radiator chamber into branched fluid passages for the circulating fluid between said inlet and outlet ports, wherein said inlet port and said outlet port are disposed in the same surface, next to each other.

13. A viscous heater according to claim 12, wherein said fluid-passages are formed along parallel arcuate paths, and the width of said fluid passages are expanded on the outer peripheral side of said passages.

14. A viscous heater according to claim 13, wherein said radiator chamber includes a front radiator chamber adjacent the front of said heat-generating chamber, and a rear radiator chamber adjacent the rear of said heat-generating chamber, and said circulating fluid, when taken in through said inlet port, is divided into the front radiator chamber and the rear radiator chamber.

15. A viscous heater according to claim 14, wherein said housing is provided with a flow divider for dividing said circulating fluid into said front radiator chamber and said rear radiator chamber, and the flow divider has a configuration free from exhibiting resistance.

16. A viscous heater according to claim 14, wherein said fin has an equal surface in said front radiator chamber and said rear radiator chamber.

17. A viscous heater according to claim 8, wherein said fin has an equal surface in said front radiator chamber and said rear radiator chamber.

* * * * *

UNITED STATES PATENT AND TRADEMARK OFFICE

CERTIFICATE OF CORRECTION

PATENT NO. : 6,089,222
DATED : July 18, 2000
INVENTOR(S) : Takashi Ban et al.

It is certified that error appears in the above-identified patent and that said Letters Patent is hereby corrected as shown below:

Column 2,
Line 64, please change "viscous heater the flow" to -- viscous heater, the flow --;

Column 3,
Line 15, please change "in the viscous heater the heat-exchanging" to -- in the viscous heater, the heat-exchanging --;
Line 31, please change "in the viscous heater the first port" to -- in the viscous heater, the first port --;

Column 5,
Line 1, please change "from the rear inside of the rear water" to -- from the inside of the rear water --;
Line 5, please change "from the rear of the rear water" to -- from the inside of the rear water --; and Column 8,
Line 45, please change "bearing apparatus:" to -- bearing apparatus; --.

Signed and Sealed this

Twelfth Day of March, 2002

*Attest:*

*Attesting Officer*

JAMES E. ROGAN
*Director of the United States Patent and Trademark Office*